US011645994B2

(12) United States Patent
Huang

(10) Patent No.: US 11,645,994 B2
(45) **Date of Patent: *May 9, 2023**

(54) DISPLAY PANEL COMPENSATING FOR RESISTANCE DIFFERENCES BETWEEN TRANSMISSION SIGNAL LINES THAT ARE COUPLED TO CLOCK SIGNAL LINES AND HAVE DIFFERENT LENGTHS, AND DISPLAY DEVICE

(71) Applicant: HKC CORPORATION LIMITED, Shenzhen (CN)

(72) Inventor: Bei Zhou Huang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/706,624

(22) Filed: Mar. 29, 2022

(65) Prior Publication Data

US 2022/0223117 A1 Jul. 14, 2022

Related U.S. Application Data

(62) Division of application No. 16/313,141, filed on Dec. 25, 2018, now Pat. No. 11,322,110.

(51) Int. Cl.
*G09G 3/36* (2006.01)

(52) U.S. Cl.
CPC ..... *G09G 3/3688* (2013.01); *G09G 3/3677* (2013.01); *G09G 2310/0286* (2013.01); *G09G 2310/08* (2013.01)

(58) Field of Classification Search
CPC ..... G09G 3/3688; G09G 3/3677; G09G 2310/0286; G09G 2310/08; G09G 2320/0223
See application file for complete search history.

(56) References Cited

U.S. PATENT DOCUMENTS 11,322,110 B2 * 5/2022 Huang ..... G09G 3/3688

* cited by examiner

*Primary Examiner* — Stephen G Sherman

(57) ABSTRACT

The present application discloses a display panel and a display device. In each set of transmission signal lines, the line width of a transmission signal line correspondingly connected to a clock signal line close to the display area is smaller than that of a transmission signal line correspondingly connected to a clock signal line away from the display area.

11 Claims, 4 Drawing Sheets

DISPLAY PANEL COMPENSATING FOR RESISTANCE DIFFERENCES BETWEEN TRANSMISSION SIGNAL LINES THAT ARE COUPLED TO CLOCK SIGNAL LINES AND HAVE DIFFERENT LENGTHS, AND DISPLAY DEVICE

This application is a division of U.S. patent application Ser. No. 16/313,141 filed Dec. 25, 2018, which is hereby incorporated by reference herein in its entirety.

TECHNICAL FIELD

The present application relates to the technical field of display, and in particular, to a display panel and a display device.

BACKGROUND

The statements herein merely provide background information related to the present application and do not necessarily constitute the prior art.

With the development and progress of technology, liquid crystal displays have many advantages such as thin bodies, power saving and no radiation, and have been widely used. Most of the liquid crystal displays known to the inventors are backlight type liquid crystal displays which each include a liquid crystal panel and a backlight module. The liquid crystal display includes a color filter (CF) substrate and an array substrate (thin film transistor (TFT)) substrate. Transparent electrodes are disposed on the opposite inner sides of the aforementioned substrates. A layer of liquid crystal (LC) molecules is sandwiched between the two substrates.

One method known to the inventors is to set a shift register gate on array (GOA) on the array substrate. The main advantages are that a gate driver IC can be omitted, and the cost is reduced. An original scan driving gate driver function utilizes an exposure and development method of the array substrate to generate a logic circuit to drive scan lines and data lines, and the shift register drives the scan lines through a gate circuit by using a clock signal, but as the display panel becomes larger, the problem that the display effect at different positions are not uniform enough may occur.

SUMMARY

In view of the above drawbacks of the prior art, the present application provides a display panel with a uniform display effect.

To achieve the above objective, the present application provides a display panel, which includes:

a display screen; and a data driver IC;

the display screen includes a display area and a non-display area;

the display area includes a plurality of sets of scan lines;

the non-display area is provided with a scan driving circuit; the scan driving circuit includes:

a plurality of shift registers;

a plurality of sets of transmission signal lines, which are connected in one-to-one correspondence with the scan lines of the display area; and a set of clock signal lines, which is respectively in signal connection with the data driver IC of the display screen to obtain a gate driving clock signal;

where each transmission signal line in each set of transmission signal lines is respectively in signal connection with a corresponding clock signal line in a set of clock signal lines; each of the transmission signal lines is in signal connection with the scan line of the display area through the corresponding shift register;

where in each set of transmission signal lines, the line width of a transmission signal line correspondingly connected to a clock signal line close to the display area is smaller than that of a transmission signal line correspondingly connected to a clock signal line away from the display area.

Optionally, between the different sets of transmission signal lines, the line width of the transmission signal line away from the data driver IC is wider.

Optionally, the clock signal line and the transmission signal line are made by a process of two different metal layers, the scan driving circuit further includes a metal bridging hole, one end of the metal bridging hole is electrically connected to the clock signal line, and the other end is electrically connected to the transmission signal line corresponding to the clock signal line.

Optionally, in the same set of clock signal lines, the line width of a transmission signal line correspondingly connected with a clock signal line away from the display area is greater than the width of the metal bridging hole.

Optionally, in the same set of clock signal lines, the line width of the clock signal line correspondingly connected with the clock signal line closest to the display area is equal to the width of the metal bridging hole.

Optionally, the line width of each transmission signal line in the same set of transmission signal lines is sequentially decreased in the direction towards the display area.

Optionally, in each of the sets of transmission signal lines, each transmission signal line has the same resistance.

Optionally, each of the transmission signal lines between the sets of transmission signal lines has the same resistance.

The present application further discloses a display panel, which includes:

a display screen; and a data driver IC;

the display screen includes a display area and a non-display area;

the display area includes a plurality of sets of scan lines;

the non-display area is provided with a scan driving circuit; the scan driving circuit includes:

a plurality of shift registers;

a plurality of sets of transmission signal lines, which are connected in one-to-one correspondence with the scan lines of the display area; and a set of clock signal lines, which is respectively in signal connection with the data driver IC of the display screen to obtain a gate driving clock signal;

where each transmission signal line in each set of transmission signal lines is respectively in signal connection with a corresponding clock signal line in a set of clock signal lines; each of the transmission signal lines is in signal connection with a corresponding scan line of the display area through a corresponding shift register;

where in each set of transmission signal lines, the line width of a transmission signal line correspondingly connected to a clock signal line close to the display area is smaller than that of a transmission signal line correspondingly connected to a clock signal line away from the display area;

the clock signal line and the transmission signal line are made by a process of two different metal layers, the scan driving circuit further includes a metal bridging hole, one end of the metal bridging hole is connected to the clock signal line, and the other end is connected to the transmission signal line;

the line width of the transmission signal line correspondingly connected with the clock signal line away from the display area is greater than the width of the metal bridging hole;

the line width of the transmission signal line correspondingly connected with the clock signal line closest to the display area is equal to the width of the metal bridging hole;

the line width of each transmission signal line of the set of transmission signal lines is sequentially decreased in the direction towards the display area.

The present application further discloses a display device including the display panel as described above.

Compared with an exemplary display panel, in the present application, for the same set of transmission signal lines connected to different clock signal lines, the length of the transmission signal line correspondingly connected to the clock signal line close to the display area is shorter, and the corresponding line resistance is smaller. In a set of transmission signal lines, the length of each transmission signal line is different, and the length of the transmission signal line correspondingly connected to the clock signal line away from the display area is longer, and the corresponding line resistance is larger. When the clock signal line transmits the clock signal to the transmission signal line, the losses caused by different resistances are also different. In the same set of transmission signal lines connected to different clock signal lines, the line width of the transmission signal line correspondingly connected to the clock signal line away from the display area is set to be greater than that of the transmission signal line correspondingly connected to the clock signal line close to the display area, so that the longer transmission signal line in a set of transmission signal lines has a larger line width, the corresponding line resistance becomes small, and the resistance loss of each transmission signal line in the set of transmission signal lines is kept consistent.

BRIEF DESCRIPTION OF DRAWINGS

The drawings are included to provide further understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

Figure 1:
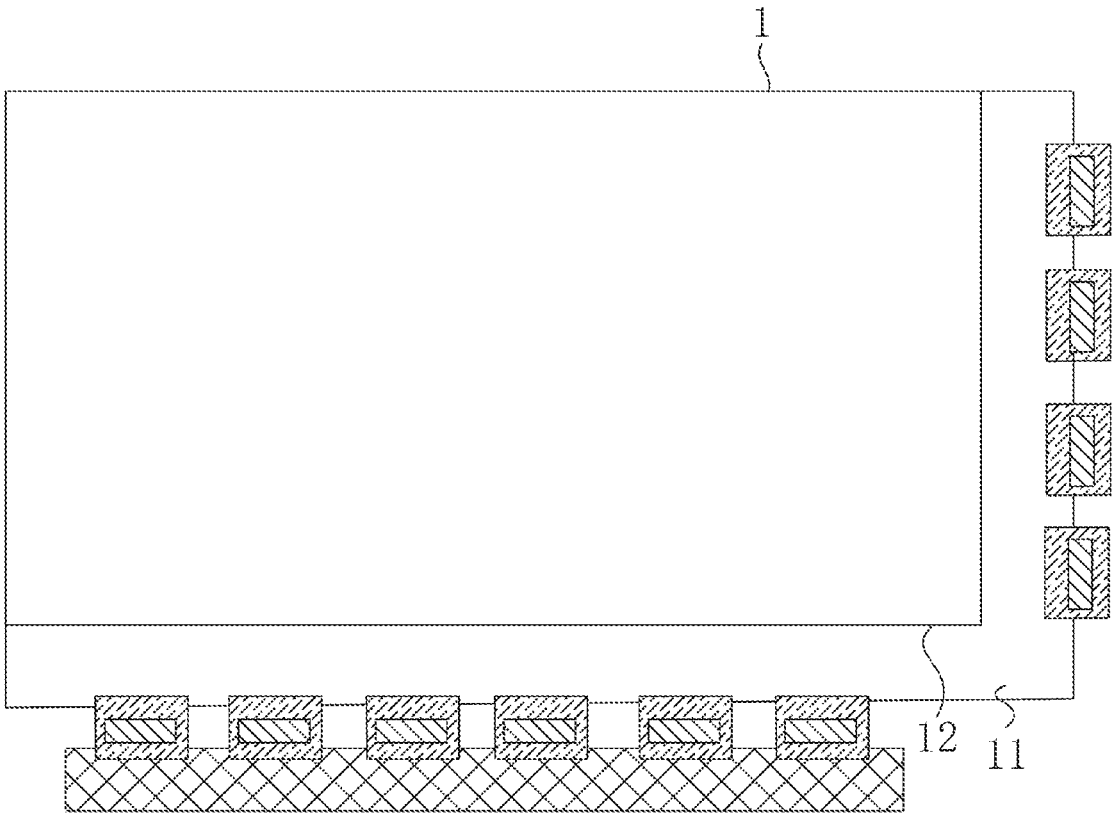
FIG. 1 is a schematic view of a display panel according to an embodiment of the present application.

The specific structure and function details disclosed herein are merely representative, and are intended to describe exemplary embodiments of the present application. However, the present application can be specifically embodied in many alternative forms, and should not be interpreted to be limited to the embodiments described herein.

In the description of the present application, it should be understood that, orientation or position relationships indicated by the terms "center", "transversal", "upper", "lower", "left", "right", "vertical", "horizontal", "top", "bottom", "inner", "outer", etc. are based on the orientation or position relationships as shown in the drawings, for ease of the description of the present application and simplifying the description only, rather than indicating or implying that the indicated device or element must have a particular orientation or be constructed and operated in a particular orientation. Therefore, these terms should not be understood as a limitation to the present application. In addition, the terms such as "first" and "second" are merely for a descriptive purpose, and cannot be understood as indicating or implying a relative importance, or implicitly indicating the number of the indicated technical features. Hence, the features defined by "first" and "second" can explicitly or implicitly include one or more features. In the description of the present application, "a plurality of" means two or more, unless otherwise stated. In addition, the term "include" and any variations thereof are intended to cover a non-exclusive inclusion.

In the description of the present application, it should be understood that, unless otherwise specified and defined, the terms "install", "connected with", "connected to" should be comprehended in a broad sense. For example, these terms may be comprehended as being fixedly connected, detachably connected or integrally connected; mechanically connected or electrically connected; or directly connected or indirectly connected through an intermediate medium, or in an internal communication between two elements. The specific meanings about the foregoing terms in the present application may be understood by those skilled in the art according to specific circumstances.

The terms used herein are merely for the purpose of describing the specific embodiments, and are not intended to limit the exemplary embodiments. As used herein, the singular forms "a", "an" are intended to include the plural forms as well, unless otherwise indicated in the context clearly. It will be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

The present application will be further described below with reference to the accompanying drawings and preferred embodiments.

As shown in FIGS. 1 to 4, a shift register gate on array (GOA) is arranged on the array substrate. In panel design, a gate driver IC can be omitted, and the cost is reduced. An original scan driver gate driver function utilizes an exposure and development method of the array substrate to generate a logic circuit to drive scan lines and data lines, and the shift register drives the scan lines through a gate circuit by using a clock signal. The GOA circuit principle is developed on the basis of the Thompson circuit. When the GOA is working, a boost point has a pre-charge signal (st) for pre-charge of this point, so that when the boost point and a clock signal are coupled, the boost point reaches a high voltage level, and a thin film transistor (TFT) is turned on to allow the signal to pass smoothly.

Figure 2:
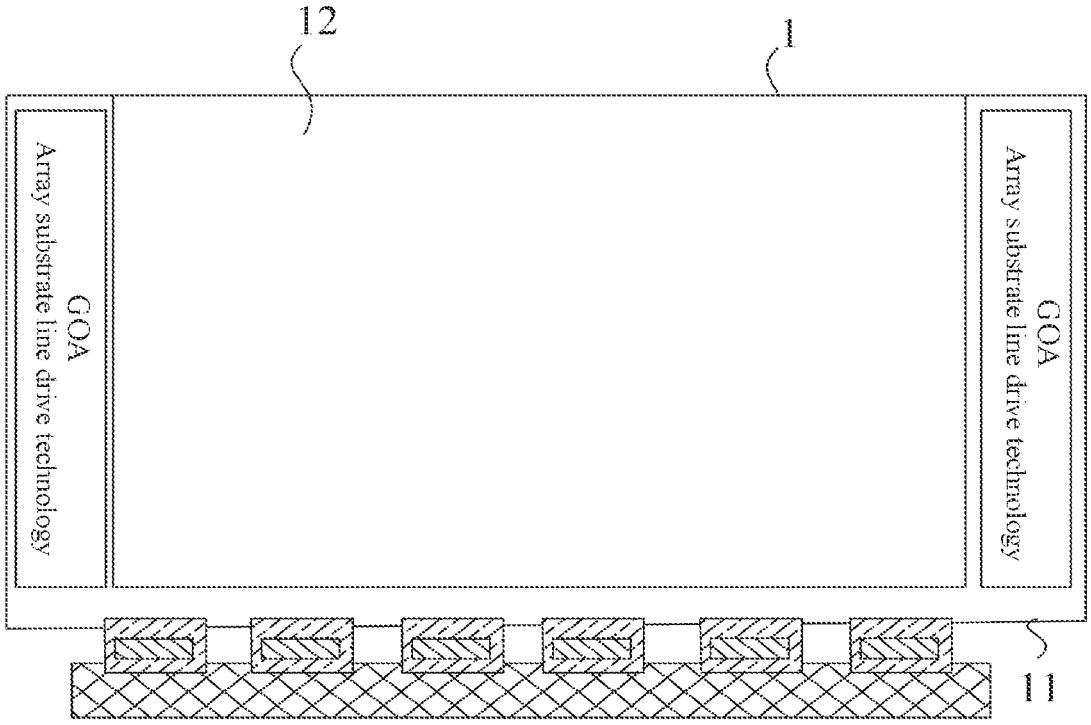
FIG. 2 is a schematic view of another display panel according to an embodiment of the present application.
Figure 5:
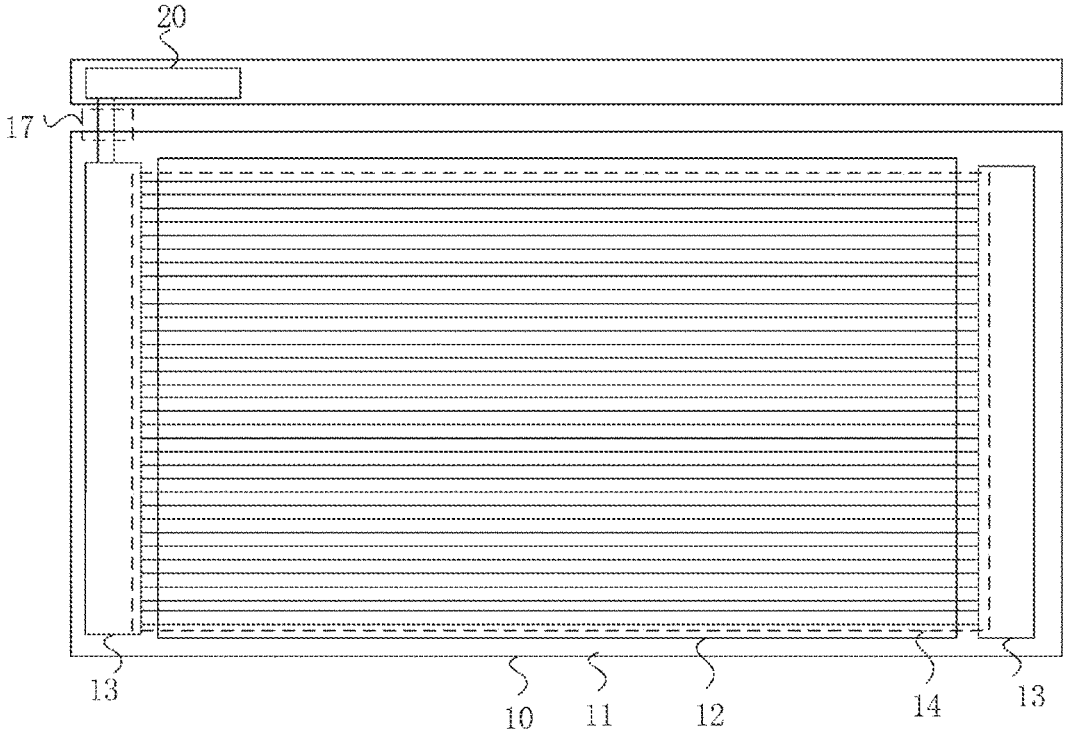
FIG. 5 is a schematic view of another display panel according to an embodiment of the present application.
Figure 6:
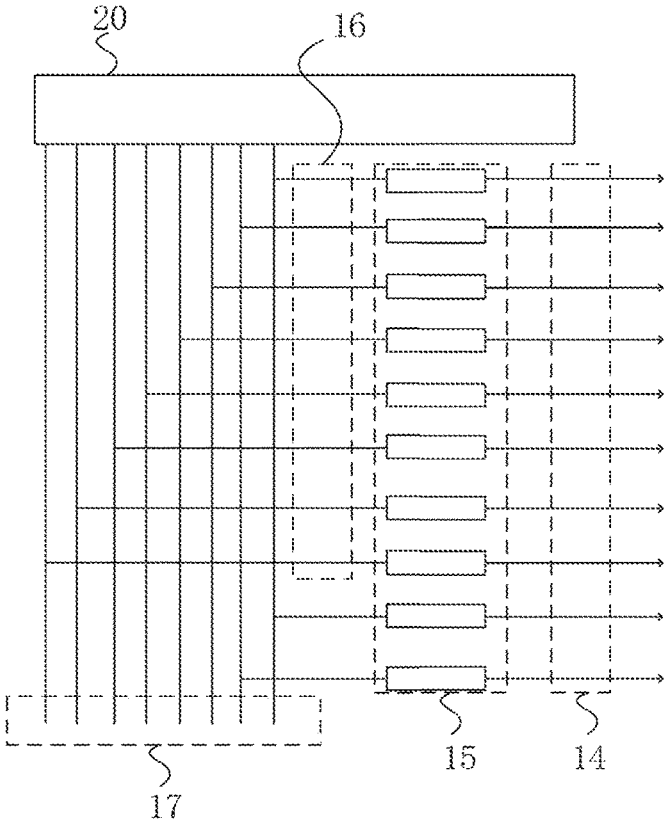
FIG. 6 is a schematic view of a scan driving circuit of a display panel according to an embodiment of the present application.
Figure 7:
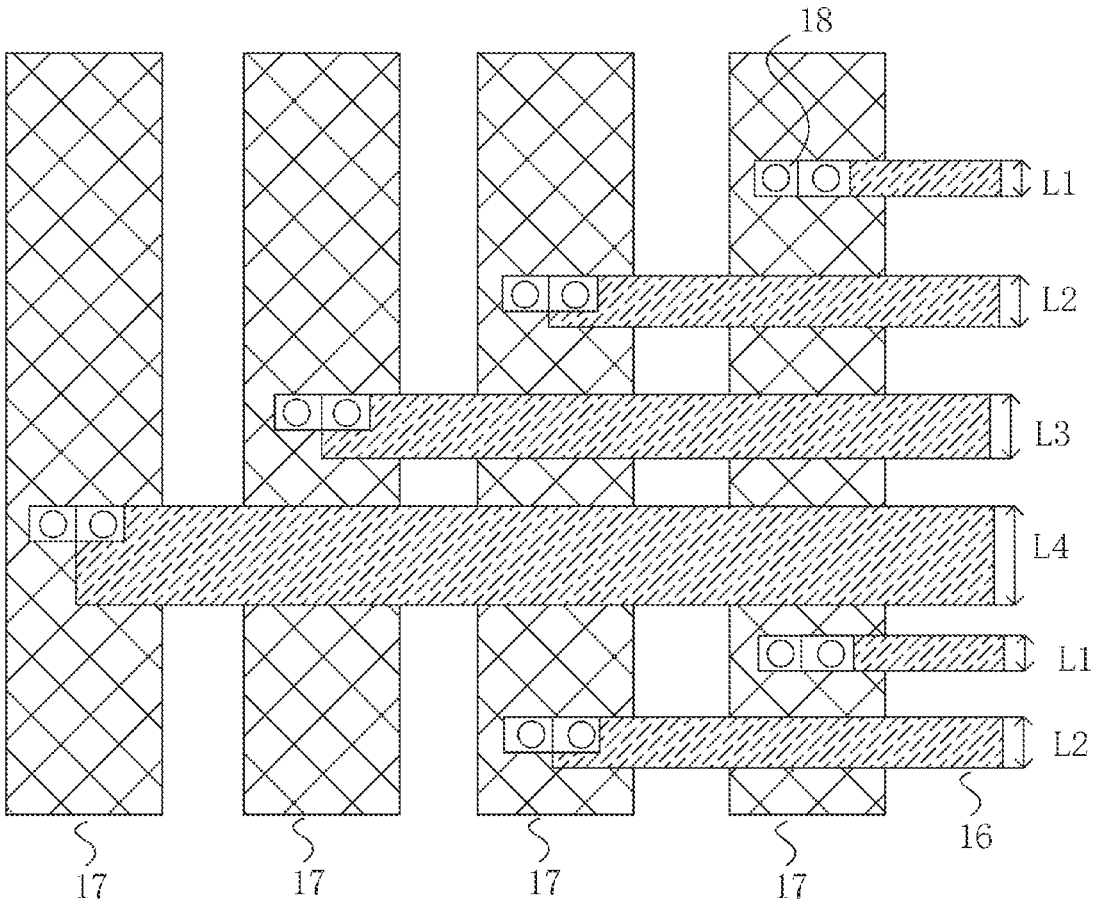
FIG. 7 is a schematic view of a scan driving circuit of another display panel according to an embodiment of the present application.

As shown in FIG. 5 to FIG. 7, an embodiment of the present application discloses a display panel, including:

a display screen 10; and a data driver IC 20;

the display screen 10 includes a display area 12 and a non-display area 11;

the display area 12 includes a plurality of sets of scan lines 14;

the non-display area 11 is provided with a scan driving circuit 13; the scan driving circuit 13 includes:

a plurality of shift registers 15;

a plurality of sets of transmission signal lines 16, which are connected in one-to-one correspondence with the scan lines 14 of the display area 12; and a set of clock signal lines 17, which is respectively in signal connection with the data driver IC 20 of the display screen 10 to obtain a gate driving clock signal;

where each transmission signal line 16 in each set of transmission signal lines 16 is respectively in signal connection with a corresponding clock signal line 17 in a set of clock signal lines 17; each transmission signal line 16 is in signal connection with the scan line 14 of the display area 12 through the corresponding shift register 15;

The scan line 14 is determined according to the resolution of the screen. For example, for the resolution of full high definition (FHD) (1920×1080), the scan lines 14 are arranged under the pixel 1G1D, and there are 1080 scan lines 14. However, the purpose of the clock signal is to provide signals to drive these scan lines 14, the clock signals assign the scan lines 14 based on the number of the signals. As shown in FIG. 2, taking 8 clock signal lines 17 as an example, in the case of 1080 scan lines 14, one clock signal line 17 is responsible for 1080/8=135 scan lines 14. In FIG. 2, a set of clock signal lines 17 includes 8 clock signal lines 17, one clock signal line 17 corresponds to 135 scan lines 14, and one set of scan lines 14 corresponds to 8 scan lines 14 and is in one-to-one connection with 8 clock signal lines 17 through corresponding 8 transmission signal lines 16.

In each set of transmission signal lines 16, the line width of a transmission signal line 16 correspondingly connected to a clock signal line 17 close to the display area 12 is smaller than that of a transmission signal line 16 correspondingly connected to a clock signal line 17 away from the display area 12.

In this solution, for the same set of transmission signal lines 17 connected to different clock signal lines, the length of the transmission signal line 16 correspondingly connected to the clock signal line 17 close to the display area 12 is shorter, and the corresponding line resistance is smaller. In a set of transmission signal lines 16, the length of each transmission signal line 16 is different, and the length of the transmission signal line 16 correspondingly connected to the clock signal line 17 away from the display area 12 is longer, and the corresponding line resistance is larger. When the clock signal line 17 transmits the clock signal to the transmission signal line 16, the losses caused by different resistances are also different. In the same set of transmission signal lines 16 connected to different clock signal lines 17, the line width of the transmission signal line 16 correspondingly connected to the clock signal line 17 away from the display area 12 is set to be greater than that of the transmission signal line 16 correspondingly connected to the clock signal line 17 close to the display area 12, so that the longer transmission signal line 16 in a set of transmission signal line 16 has a greater line width, the corresponding larger line resistance becomes small, and the resistance loss of each transmission signal line 16 in the set of transmission signal lines 16 is kept consistent.

Optionally, in this embodiment, between the different sets of transmission signal lines 16, the line width of the transmission signal line 16 away from the data driver IC 20 is wider.

In this solution, the clock signal line 17 away from the data driver IC 20 is longer, different signal line lengths cause the losses to be different, and the clock signal on the clock signal line 17 away from the data driver IC 20 has a greater loss, the transmission signal line 16 away from the data driver IC 20 has a greater line width, so that it can be ensured that the line resistance of the transmission signal line 16 away from the data driver IC 20 becomes small, the loss of the clock signal on the transmission signal line 16 away from the data driver IC 20 is reduced, to avoid excessive losses, and the difference of intensity from that of the clock signal on the transmission signal line 16 close to the data driver IC 20 is prevented from being too large.

In this embodiment, optionally, the clock signal line 17 and the transmission signal line 16 are made by a process of two different metal layers, the scan driving circuit 13 further includes a metal bridging hole 18, one end of the metal bridging hole 18 is connected to the clock signal line 17, and the other end is electrically connected to the transmission signal line 16 corresponding to the clock signal line 17, and the overlapping portions outside the metal bridging hole 18 are insulated from each other.

In this solution, the metal bridging hole 18 and the TFT of the display area 12 and the data lines and scan lines 14 are completed by the same process, which is a GOA circuit process, is highly achievable and does not incur additional cost.

In this embodiment, optionally, in the same set of clock signal lines, the line width of a transmission signal line 16 correspondingly connected with a clock signal line 17 away from the display area 12 is greater than the width of the metal bridging hole 18.

In this solution, the greater the line width of the transmission signal line 16 correspondingly connected to the clock signal line 17 away from the display area 12 is, the smaller the resistance is, and the smaller the loss generated by the clock signal is, so that compensation can be made for the loss generated by the line length of the transmission signal line 16 correspondingly connected with the clock signal line 17 away from the display area 12.

In this embodiment, optionally, in the same set of clock signal lines, the line width of the transmission signal line 16 correspondingly connected with the clock signal line 17 closest to the display area 12 is equal to the width of the metal bridging hole 18.

In this solution, the line width of the transmission signal line 16 correspondingly connected with the clock signal line 17 closest to the display area 12 is equal to the width of the metal bridging hole 18, which is the minimum width of the transmission signal line 16, and if it is smaller, the transmission signal line will be in poor contact with the metal bridging hole 18, and a breakage will occur. Due to the limited panel space, this is an optimal wiring design.

Figure 3:
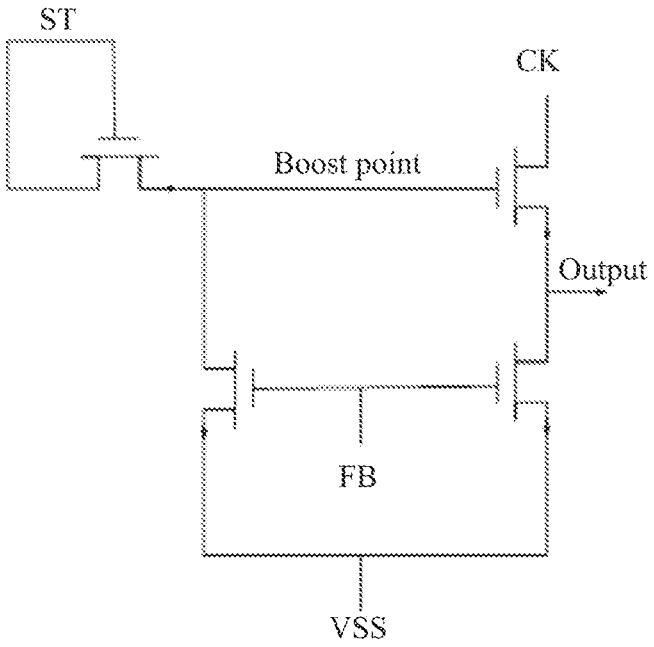
FIG. 3 is a schematic view of a GOA circuit of a display panel according to an embodiment of the present application.
Figure 4:
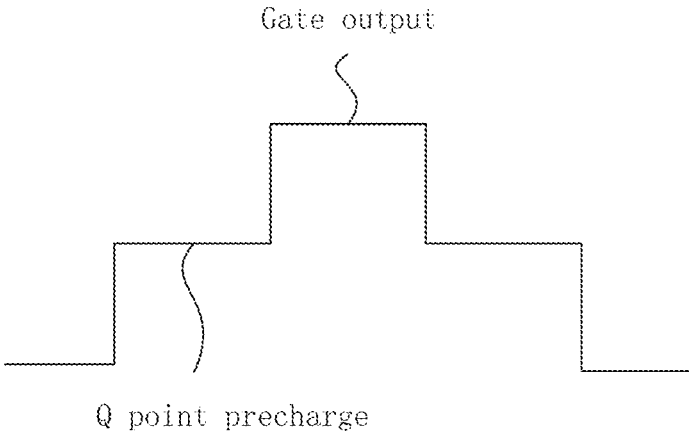
FIG. 4 is a schematic view of a clock signal of a display panel according to an embodiment of the present application.

Optionally, in this embodiment, the line width of each transmission signal line 16 in the same set of transmission signal lines 16 is sequentially decreased in the direction towards the display area 12. In FIG. 3, a set of clock signal lines 17 includes 4 clock signal lines 17, and a set of scan lines 14 corresponds to 4 scan lines 14, and is in one-to-one connection with 4 clock signal lines 17 through the corresponding 4 transmission signal lines 16. The widths from the width L4 of the transmission signal line correspondingly electrically connected with the same group of clock signal lines away from the display area to the width L1 of the transmission signal line correspondingly electrically connected to the clock signal line close to the display area are sequentially decreased.

In this solution, the lengths of the transmission signal lines 16 corresponding to the clock signal lines 17 that are from close to the display area 12 to away from display area 12 are sequentially increased in a set of transmission signal lines 16, and the longer the line length is, the more the loss is, so that the line width of each transmission signal line 16 in this set of transmission signal lines 16 is sequentially decreased, and the loss on the transmission signal line 16 is increased as the width of the transmission signal line 16 is decreased, thereby compensating for the loss difference caused by the line length difference, so that the loss on each transmission signal line 16 is consistent.

Optionally, in this embodiment, each transmission signal line 16 in each set of transmission signal lines 16 has the same resistance.

In this solution, the resistance of each transmission signal line 16 in each set of transmission signal lines 16 is the same, and then the loss of the clock signal on each transmission signal line 16 is consistent, so that the intensity of each scan line 14 in each set is consistent.

Optionally, in this embodiment, between the sets of transmission signal lines 16, the resistance of each of the transmission signal lines 16 is the same.

Each of the transmission signal lines 16 between the sets of transmission signal lines 16 has the same resistance, i.e., each transmission signal line 16 in plurality of sets of transmission signal lines 16 has the same resistance, and the loss is the same when the clock signal passes.

In this solution, when the panel is larger and the clock signal passes through the clock signal line 17, different losses occur during the transmission of the clock signal on the transmission signal line 16 away from the data driver IC 20 and the transmission signal line 16 close to the data driver IC 20. The problem of panel display unevenness is more prominent, and the widths L1 of the closest clock signal lines 17 between the respective sets of transmission signal lines 16 are not necessarily equal. Between the different sets of transmission signal lines 16, as shown in FIG. 3, the width L1 of a transmission signal line 16 close to the clock signal line 17 in the last set (the set farthest from the driver IC) of transmission signal lines 16 may be greater than the width L4 of a transmission signal line 16 away from the clock signal line 17 in the first set of transmission signal lines 16.

As shown in FIGS. 5 to 7, another embodiment of the present application discloses a display panel, including:

a display screen 10; and a data driver IC 20;

the display screen 10 includes a display area 12 and a non-display area 11;

the display area 12 includes a plurality of sets of scan lines 14;

the non-display area 11 is provided with a scan driving circuit 13; the scan driving circuit 13 includes:

a plurality of shift registers 15;

a plurality of sets of transmission signal lines 16, which are connected in one-to-one correspondence with the scan lines 14 of the display area 12; and a set of clock signal lines 17, which is respectively in signal connection with the data driver IC 20 of the display screen 10 to obtain a gate driving clock signal;

where each transmission signal line 16 in each set of transmission signal lines 16 is respectively in signal connection with a corresponding clock signal line 17 in a set of clock signal lines 17; each transmission signal line 16 is in signal connection with a corresponding scan line 14 of the display area 12 through a corresponding shift register 15;

where in each set of transmission signal lines 16, the line width of a transmission signal line 16 correspondingly connected to a clock signal line 17 close to the display area 12 is smaller than that of a transmission signal line 16 correspondingly connected to a clock signal line 17 away from the display area 12;

the clock signal line 17 and the transmission signal line 16 are made by a process of two different metal layers. The scan driving circuit 13 further includes a metal bridging hole 18, one end of the metal bridging hole 18 is connected to the clock signal line 17, and the other end is connected to the transmission signal line 16;

the line width of the transmission signal line 16 correspondingly connected with a clock signal line 17 away from the display area 12 is greater than the width of the metal bridging hole 18;

the line width of the transmission signal line 16 correspondingly connected with the clock signal line 17 closest to the display area 12 is equal to the width of the metal bridging hole 18;

the line width of each transmission signal line 16 in a set of transmission signal lines 16 is sequentially decreased in the direction towards the display area 12.

As shown in FIG. 5 to FIG. 7, another embodiment of the present application discloses a display device, and the display device includes the aforementioned display panel.

The panel of the present application may be a twisted nematic (TN) panel, an in-plane switching (IPS) panel, or a multi-domain vertical alignment (VA) panel, and of course, the panel may also be other types of panels, as long as the panels are suitable.

The above are further detailed descriptions of the present application in conjunction with the specific preferred embodiments, but the specific implementation of the present application cannot be determined as limited to these descriptions. For a person of ordinary skill in the art to which the present application pertains, a number of simple deductions or substitutions may also be made without departing from the concept of the present application. All these should be considered as falling within the scope of protection of the present application.

What is claimed is:

1. A display panel, comprising:

a display screen; and a data driver IC;

wherein the display screen comprises a display area and a non-display area;

the display area comprises a plurality of sets of scan lines;

the non-display area comprises a scan driving circuit; wherein the scan driving circuit comprises:

a plurality of shift registers;

a plurality of sets of transmission signal lines, which are connected in one-to-one correspondence with the scan lines of the display area; and a set of clock signal lines, each of which is in a signal connection with the data driver IC of the display screen and is configured to receive a gate driving clock signal;

wherein in each set of transmission signal lines, each transmission signal line is in a signal connection with a corresponding clock signal line in a set of clock signal lines; each of the transmission signal lines is in a signal connection with a corresponding scan line of the display area through a corresponding shift register;

wherein in each set of transmission signal lines, a line width of a transmission signal line connected to a clock signal line close to the display area is smaller than that of a transmission signal line connected to a clock signal line away from the display area;

wherein the clock signal lines and the transmission signal lines are made by a process of two different metal layers, wherein the scan driving circuit further comprises a metal bridging hole, one end of the metal bridging hole is electrically connected to the corresponding clock signal line, and the other end is electrically connected to the transmission signal line corresponding to the clock signal line; and wherein in a same set of clock signal lines, a line width of a transmission signal line correspondingly connected with a clock signal line closest to the display area is equal to the width of the metal bridging hole.

2. The display panel according to claim 1, wherein between different sets of transmission signal lines, the line width of the transmission signal line farther away from the data driver IC is wider.

3. The display panel according to claim 1, wherein the line width of each transmission signal line in a same set of transmission signal lines is sequentially decreased in the direction towards nearing the display area.

4. The display panel according to claim 1, wherein each transmission signal line in each set of transmission signal lines has the same resistance.

5. The display panel according to claim 1, wherein each transmission signal line in the plurality of sets of transmission signal lines has the same resistance.

6. The display panel according to claim 1, wherein the metal bridging hole, TFTs of the display area, data lines, and the scan lines are created in a same process.

7. A display device, comprising a display panel;

the display panel comprises:

a display screen; and a data driver IC;

wherein the display screen comprises a display area and a non-display area;

the display area comprises a plurality of sets of scan lines;

the non-display area comprises a scan driving circuit; wherein the scan driving circuit comprises:

a plurality of shift registers;

a plurality of sets of transmission signal lines, which are connected in one-to-one correspondence with the scan lines of the display area; and a set of clock signal lines, each of which is in a signal connection with the data driver IC of the display screen and is configured to receive a gate driving clock signal;

wherein in each set of transmission signal lines, each transmission signal line is in a signal connection with a corresponding clock signal line in a set of clock signal lines; each of the transmission signal lines is in a signal connection with a corresponding scan line of the display area through a corresponding shift register;

wherein in each set of transmission signal lines, a line width of a transmission signal line connected to a clock signal line close to the display area is smaller than that of a transmission signal line connected to a clock signal line away from the display area;

wherein the clock signal lines and the transmission signal lines are made by a process of two different metal layers, the scan driving circuit further comprises a metal bridging hole, one end of the metal bridging hole is electrically connected to the corresponding clock signal line, and the other end is electrically connected to the transmission signal line corresponding to the clock signal line; and wherein in a same set of clock signal lines, a line width of a transmission signal line correspondingly connected with a clock signal line closest to the display area is equal to the width of the metal bridging hole.

8. The display device according to claim 7, wherein between different sets of transmission signal lines, the line width of the transmission signal line farther away from the data driver IC is wider.

9. The display device according to claim 7, wherein the line width of each transmission signal line in a same set of transmission signal lines is sequentially decreased in the direction towards nearing the display area.

10. The display device according to claim 7, wherein in each of the sets of transmission signal lines, each transmission signal line has the same resistance.

11. The display device according to claim 7, wherein each transmission signal line in the plurality of sets of transmission signal lines has the same resistance.

* * * * *